United States Patent [19]

Mikami et al.

[11] 4,167,927

[45] Sep. 18, 1979

[54] CONTACTLESS IGNITION CONTROL SYSTEM WITH A DWELL TIME CONTROL CIRCUIT FOR AN INTERNAL COMBUSTION ENGINE

[75] Inventors: Youichi Mikami, Toyota; Koichi Toyama, Kariya; Yasushi Sugiura, Handa, all of Japan

[73] Assignee: Nippondenso Co., Ltd., Kariya, Japan

[21] Appl. No.: 835,850

[22] Filed: Sep. 22, 1977

[30] Foreign Application Priority Data

Oct. 6, 1976 [JP] Japan ..... 51/120597

[51] Int. Cl.[2] ..... F02P 3/02; F02P 1/08; H05B 41/36

[52] U.S. Cl. ..... 123/148 E; 123/146.5 A; 315/209 T

[58] Field of Search ..... 123/148 E, 146.5 A, 123/117 R; 315/209 T

[56] References Cited

U.S. PATENT DOCUMENTS

| | | | |
|---|---|---|---|
| 3,294,076 | 12/1966 | Mieras | 123/148 E |
| 3,587,551 | 6/1971 | Harrow | 123/148 E |
| 3,797,471 | 3/1974 | Schuette | 123/148 E |
| 3,874,355 | 4/1975 | Suda et al. | 123/148 E |
| 3,881,458 | 5/1975 | Roozenbeek et al. | 123/148 E |
| 3,937,193 | 2/1976 | Kim | 123/117 R |
| 4,064,859 | 12/1977 | Kashiwazaki | 123/148 E |

*Primary Examiner*—Charles J. Myhre
*Assistant Examiner*—P. S. Lall
*Attorney, Agent, or Firm*—Cushman, Darby & Cushman

[57] ABSTRACT

In a contactless ignition control system having a dwell time control circuit for an internal combustion engine, there is provided a speed responsive bias voltage circuit, a bias voltge switching circuit and a wave shaping circuit. The speed responsive bias voltage changes the switching level of the wave shaping circuit, thereby elongating the dwell time of the current flowing through an ignition coil.

In the dwell time control, when the ignition timing comes, the bias voltage switching circuit prevents application of the speed responsive bias voltage so that the ignition timing is made irrespective of the speed responsive bias voltage.

6 Claims, 3 Drawing Figures

CONTACTLESS IGNITION CONTROL SYSTEM WITH A DWELL TIME CONTROL CIRCUIT FOR AN INTERNAL COMBUSTION ENGINE

BACKGROUND OF THE INVENTION

The present invention relates to an improvement in a contactless ignition system having a dwell time control circuit for an engine such as disclosed in Japanese patent publication, Sho 41-2803, published on Feb. 22, 1966, assigned to the same assignee of the present application.

In the above Japanese patent publication, there is shown an ignition control system having a dwell time control circuit which comprises an AC generator for generating an alternating current signal having timed relationship with the engine. Such signal is shown in (a) of FIG. 1 of the present application in which an engine speed responsive bias voltage changing circuit for generating speed responsive DC signal, as designated by $V_O$ (low speed) and $V_O'$ (high speed) in (a) of FIG. 1 of the present application, a waveshaping circuit for generating a rectangular control signal and a switching circuit for controlling charge and discharge of an ignition coil in response to the rectangular control signal. The waveshaping circuit is so arranged that the width of the rectangular signal thereof is made longer in accordance with the engine speed responsive DC voltage as the engine speed increases, as shown in (b) and (c) of FIG. 1 of the present application. As a result, the portion of each alternating cycle during which the ignition coil is energized is increased as the engine speed increases, thereby ensuring a good igniteability of the engine even in the high speed range-thereof.

However, it has been found to be a drawback that the ignition timing at which the discharge of the ignition energy is made is changed with the change of the speed responsive DC voltage as designated by T in (c) of FIG. 1 of the present application. This time difference T varies with variation in the wave shape of the AC voltage due to the type, construction, and other characteristics of the AC generator. The difference T also depends on variations in the dwell time requirement and in manufacturing errors of the igniton system. Generally, the ignition timing is made advanced in a high speed range of the engine by spark advance mechanisms such as a centrifugal advancer and a vacuum advancer. However, it is practically difficult to accurately compensate such time difference T by those mechanisms.

SUMMARY OF THE INVENTION

It is, therefore, the main object of the present invention to provide an engine ignition control system with an improved dwell time control function.

It is another object of the present invention to provide an ignition control system which comprises means for selectively applying speed responsive DC voltage to the waveshaping circuit in the manner that the ignition timing is made at a constant DC voltage with the dwell time being elongated as engine speed increases.

The above and other objects will be made apparent in the following description and drawings.

DESCRIPTION OF THE PREFERRED EMBODIMENT

Figure 2:
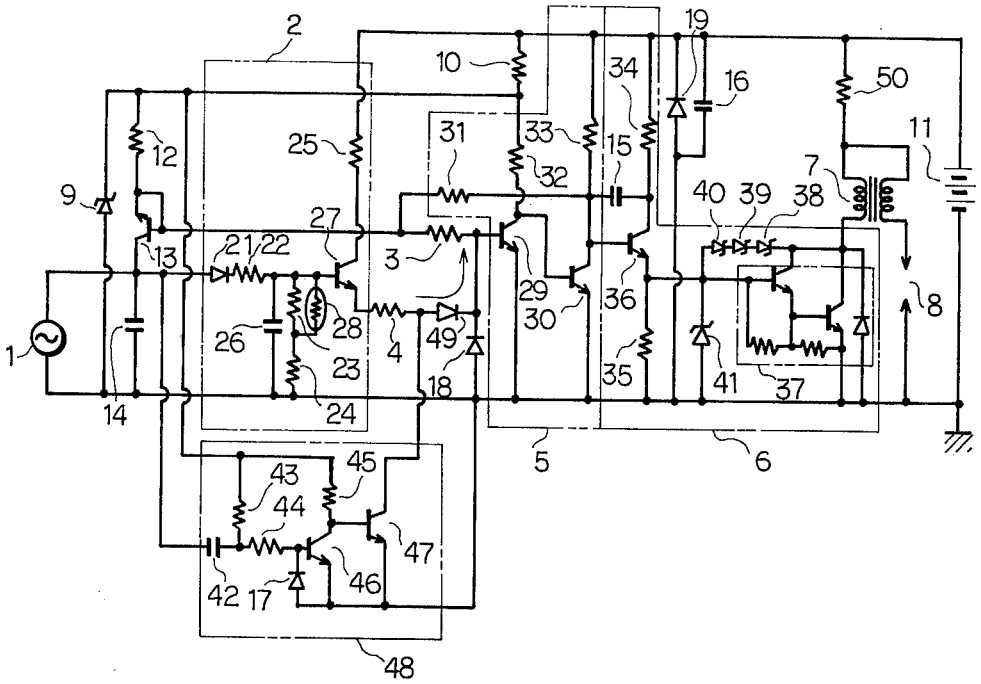
FIG. 2 is a circuit diagram for a preferred embodiment of the present invention.

A preferred embodiment will be explained with reference to FIGS. 2 and 3.

Figure 3:
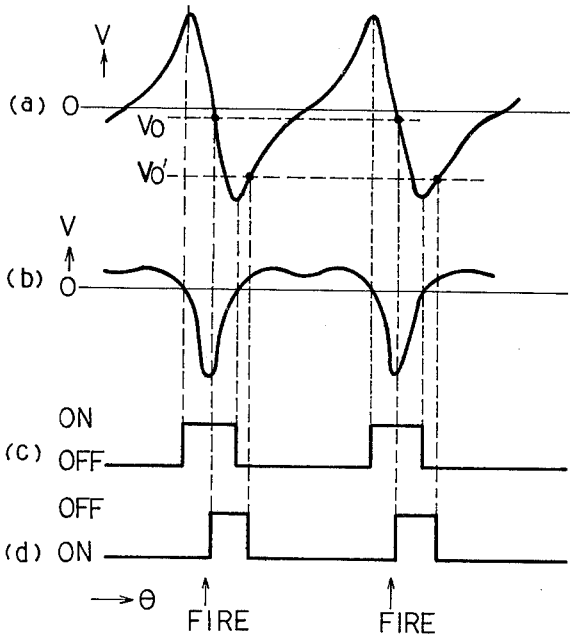
FIG. 3 is a graph showing a dwell time control manner of the embodiment shown in FIG. 2.

Numeral 1 shows an AC generator which provides an alternating current signal as shown in (a) of FIG. 3 in timed relationship with an engine. A zener diode 9 provides a constant DC voltage, e.g. 7 volts in cooperation with a resistor 10 which is connected to a battery 11. A series circuit of a resistor 12 and a transistor 13 is connected at its one end to the zener diode 9 and at the other end to a capacitor 14, which is connected across the AC generator 1. The emitter and base of the transistor 13 is connected to each other in order to provide a diode function having the same temperature characteristics as a transistor 29 of a waveshaping circuit 5, which will be explained later. The capacitor 14 and other capacitors 15 and 16 are effective to prevent malfunction of the system. On this occasion, diodes 17, 18 and 19 are explained; these diodes are respectively connected to prevent the backward biasing. A bias voltage changing circuit 2 which is connected to the AC generator 1 comprises a rectifying and smoothing circuit 2 including a diode 21, resistor 22 and a capacitor 26 and a current amplifying transistor 27 with resistors 23, 24 and 25 and a thermistor 28 being connected thereto. The thermistor 28 compensates variation in the temperature responsive characteristics of the diode 21 and transistor 27. The bias voltage changing circuit 2 provides an engine speed responsive DC voltage signal which increases as the engine speed increases. Numerals 3 and 4 show resistors respectively connected to the AC generator 1 and the bias voltage changing circuit 2. The previously mentioned waveshaping circuit 5 comprises transistors 29 and 30 and resistors 31, 32 and 33. The base of the transistor 29 is connected through the resistor 3 to the base of the transistor 13. When a DC voltage exceeding a predetermined switching value is applied to the base of the transistor 29, the transistor 29 is made conductive and, thus, the transistor 30 is made nonconductive, thereby providing a rectangular signal at the junction of the resistor 33 and the collector of the transistor 30. The switching level of the transistor 29 is preferably determined to be nearly zero volt by the resistors 12, 3 and 31. Connected to the junction is a transistor 36 of a switching circuit 6, which further comprises resistors 34 and 35 connected in series with the transistor emitter-collector path, a Darlington transistor circuit 37 and surge voltage protecting zener diodes 38, 39, 40 and 41. When the rectangular signal is generated by the waveshaping circuit 5, the transistor 36 is made conductive to thereby render the Darlington transistor circuit 37 to be nonconductive. On the other hand, the Darlington circuit 37 is made conductive when the rectangular signal disappears. Numeral 7 designates an ignition coil having a primary winding connected to the Darlington circuit 37 and a secondary winding connected to spark plugs as represented by numeral 8 in FIG. 2 through a ignition distributor (not shown) in the well known manner. The ignition coil 7 is charged with an electric current supplied through a resistor 50 from the battery 11 when the Darlington transistor 37 is made conductive.

Now, a bias voltage switching circuit 48 will be explained. This circuit 48 comprises a differentiating circuit including a capacitor 42, a resistor 43 and a switching circuit including resistors 44 and 45 and transistors 46 and 47. A diode 49 is connected between the base circuit of the transistor 29 and the transistor 47 of the bias voltage switching circuit 48 so as to prevent the current flowing through the resistor 3 from flowing to the ground when the transistor 47 is made conductive. When a voltage decreasing signal is applied to the bias voltage switching circuit 48 through the capacitor 42, the transistor 46 is made nonconductive to render the transistor 47 to be conductive, thereby grounding the output signal of the bias voltage changing circuit 2.

Figure 1:
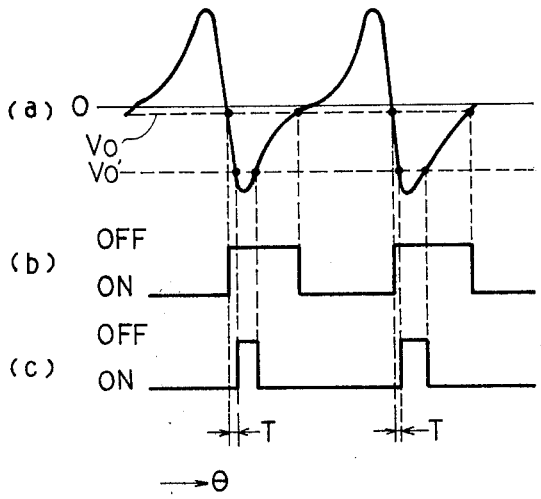
FIG. 1 is a graph showing a dwell time control manner of a conventional ignition control system.

In operation, when the engine speed is low, the AC voltage generated by the AC generator 1 is not sufficient to charge the capacitor 26 to the voltage to render the transistor 27 to be conductive, and the bias voltage of the transistor 29 is not effected by the bias voltage changing circuit 2 but is maintained at the level designated by $V_O$ in (a) of FIG. 3. As a result, the ignition coil is charged when the AC signal increases to the voltage level $V_O$ from the minimum voltage and is discharged when it decreases to the level $V_O$ from the maximum in a conventional manner as shown in (b) of FIG. 1.

When the engine speed increases, the capacitor 26 is increasingly charged to the voltage to render the transistor 27 to be conductive. As a result, the base current is supplied to the transistor 29 increasingly as the engine speed increase through the diode 49, the resistor 3, the transistor 27 and the resistor 25 when the transistor 47 of the bias voltage switching circuit 48 is in the nonconductive state. The differentiating circuit of the bias voltage switching circuit 48 provides on the base of the transistor 46 the voltage shown in (b) of FIG. 3, which is the differentiated result of the AC voltage generated by the AC generator 1, and, consequently, the switching transistor 47 is made conductive and nonconductive as shown in (c) of FIG. 3. As a result, when the AC signal in decreasing direction reaches the voltage level $V_O$ the transistor 29 is made nonconductive since the output current of the bias voltage changing circuit 2 is bypassed through the transistor 47 being conductive. Consequently, the Darlington circuit 37 switches off the current flowing through the ignition coil 7, thereby discharging the ignition energy irrespective of the output voltage of bias voltage changing circuit 2. On the other hand, when the AC signal turns into the increasing direction from its minimum, the transistor 29 is made conductive at the level $V_O'$ since the switching transistor 47 of the bias voltage switching circuit 48 is rendered to be nonconductive by the differentiating circuit and the base potential of the transistor 29 is raised by the battery voltage in the manner as previously mentioned, and consequently the Darlington circuit 37 is made conductive relatively earlier than when the base potential of the transistor 29 is not raised by bias voltage changing circuit 2, thereby to elongate the dwell time of the current supplied to the ignition coil, as shown in (d) of FIG. 3.

In the above preferred embodiment, although the ignition timing is set in the decreasing direction of the AC signal, it may be set in the increasing direction of the AC signal. In such a modified system, the speed responsive DC signal is bypassed through the transistor 47 when the AC signal is in the increasing direction.

It is also possible that the bias voltage switching circuit 48 is connected in series with the bias voltage changing circuit 2 and the waveshaping circuit 5, and that the switching circuit interrupts application of the speed responsive DC voltage to the waveshaping circuit 5 upon the ignition timing.

What is claimed is:

1. A contactless ignition system with a dwell control circuit for an internal combustion engine comprising:

a battery;

an ignition coil having a primary winding connected to said battery and a secondary winding;

a power switching circuit connected in series to said primary winding, said battery supplying current thereto;

AC generating means for producing an alternating current signal in timed relationship with the engine;

bias voltage changing means connected to said AC generating means for providing a DC voltage signal responsive to the engine speed;

timing control means having a switching element and connected to said AC generating means for controlling said power switching circuit by switching on and off said switching element in synchronism with the engine; and means for switching said timing control switching element to cause said power switching circuit to stop conducting at a constant threshold level of said alternating current signal, independent of said DC voltage signal, and switching said timing control switching element to cause said power switching circuit to start conducting at a threshold level of said alternating current signal related to said DC voltage signal to elongate the dwell angle of the current flowing through said primary winding, said switching means connected to said bias voltage changing means and said timing control means and selectively applying said DC voltage signal to said timing control means in response to one of the increase and decrease in said alternating current signal to alter the alternating current threshold level at which said power switching circuit turns on.

2. A contactless ignition system according to claim 1, wherein said timing control means comprises:

a waveshaping circuit having a transistor, whose switching level changes in response to the DC voltage signal of said bias voltage changing means.

3. A contactless ignition system according to claim 1, wherein said switching means comprises:

differentiating means connected to said AC generator, and a switching circuit connected to said differentiating circuit.

4. A contactless ignition system with a dwell time control circuit for an internal combustion engine comprising:

an engine igniton device having an ignition coil and an ignition current switching transistor;

AC generating means for producing an alternating current signal in timed relationship with the engine;

timing control means having a switching element and connected to said AC generating means for controlling said switching transistor in response to the alternating current signal of said AC generating means;

engine speed responsive DC voltage generating means for generating a DC voltage signal related to engine speed;

means for differentiating said alternating current signal;

means responsive to said differentiated said alternating current signal and said alternating current signal for switching said timing control switching element to cause said power switching circuit to stop conducting at a constant threshold level of said alternating current signal, independent of said DC voltage signal, and switching said timing control switching element to cause said power switching circuit to start conducting at a threshold level of said alternating current signal related to said DC voltage signal to elongate the dwell angle of the current flowing through the primary winding of said ignition coil, said switching means connected to said timing control means and said DC voltage generating means and responsive to said differentiating means for selectively applying said DC voltage signal to said timing control means in response to the polarity of said differentiated said alternating current signal to alter the alternating current threshold level at which said power switching circuit turns on.

5. In a contactless ignition system with a dwell control circuit for an internal combustion engine including a battery, an ignition coil having a primary winding connected to said battery and a secondary winding, power switching means connected in series to said primary winding, said battery supplying current thereto, AC generating means for producing an alternating current signal, having portions with a first slope polarity and portions with a second slope polarity, in timed relationship with the engine, bias voltage changing means connected to said AC generating means for producing an output of at least a first DC voltage signal only when the engine speed is above a predetermined value, and timing control means responsive to said AC generating means and said bias voltage changing means, and having a switching element, said power switching means being responsive to said switching element, for controlling said power switching means by switching on and off said switching element at a first said alternating current signal threshold level in response to said first DC voltage signal and at a second said alternating current signal threshold level in response to the absence of said first DC voltage signal;

the improvement wherein said system further comprises:

means, responsive to said alternating current signal, and connected to said bias voltage changing means and said timing control means for applying said first DC voltage signal to said timing control means only when said alternating current signal has said first slope polarity to elongate the dwell angle of the current flowing through said primary winding at speeds above said predetermined value.

6. A contactless ignition system with a dwell time control circuit for an internal combustion engine comprising:

an engine ignition device having an ignition coil and an ignition current switching transistor;

AC generating means for producing an alternating current signal in timed relationship with the engine;

bias voltage changing means connected to said AC generating means for producing an output of at least a first DC voltage signal only when the engine speed is above a predetermined value;

timing control means, responsive to said AC generating means and said bias voltage changing means, and having a switching element, said current switching transistor being responsive to said switching element, for controlling said current switching transistor by switching on and off said switching element at a first said alternating current signal threshold level in response to said first DC voltage signal and at a second said alternating current signal threshold level in response to the absence of said first DC voltage signal;

differentiating means for producing a differentiation signal having a polarity related to the slope polarity of said alternating current signal; and switching means, responsive to said differentiation signal and connected to said bias voltage changing means and said timing control means for applying said first DC voltage signal to said timing control means only when said differentiation signal has a predetermined polarity to elongate the dwell angle of the current flowing through the primary winding of said ignition coil at speeds above said predetermined value.

* * * * *